US005199867A

United States Patent [19]

Yap

[11] Patent Number: 5,199,867

[45] Date of Patent: Apr. 6, 1993

[54] FUEL-BURNER APPARATUS AND METHOD FOR USE IN A FURNACE

[75] Inventor: Loo T. Yap, Princeton, N.J.

[73] Assignee: The BOC Group, Inc., New Providence, N.J.

[21] Appl. No.: 768,800

[22] Filed: Sep. 30, 1991

[51] Int. Cl.[5] ..... F27B 14/00; F23M 3/04; F23C 5/00

[52] U.S. Cl. ..... 432/13; 431/181; 431/187; 431/10; 431/8; 110/265

[58] Field of Search ..... 431/181.8, 186, 187, 431/159, 160, 10; 110/265; 432/13

[56] References Cited

U.S. PATENT DOCUMENTS

| | | | |
|---|---|---|---|
| 3,663,153 | 5/1972 | Bagge et al. | 431/187 |
| 4,479,442 | 10/1984 | Itse et al. | 431/186 |
| 4,669,398 | 6/1987 | Takahashi et al. | 110/265 |
| 4,726,760 | 2/1988 | Skoog | 110/265 |
| 4,838,185 | 6/1989 | Flament | 110/263 |
| 4,887,962 | 12/1989 | Hasenack et al. | 431/181 |
| 4,909,729 | 3/1990 | Donohue | 431/186 |
| 4,911,637 | 3/1990 | Moore et al. | 110/263 |
| 4,924,784 | 5/1990 | Lennon et al. | 110/265 |
| 4,928,605 | 5/1990 | Suwa et al. | 110/263 |
| 5,149,261 | 9/1992 | Suwa et al. | 431/353 |

*Primary Examiner*—Henry C. Yuen

*Attorney, Agent, or Firm*—David M. Rosenblum; Larry R. Cassett

[57] ABSTRACT

The present invention provides a burner for burning a fuel in an oxidant. In accordance with the apparatus, a fuel nozzle is provided for producing a fuel jet of the fuel adapted to burn within the oxidant with the flame extending outwardly from the fuel nozzle and such that the particles of fuel become increasingly more buoyant along the length of the flame. A lower oxidant nozzle is located below the fuel nozzle for creating a lower oxidant jet of the oxidant that produces a low-pressure field below the fuel jet for downwardly spreading the fuel into the oxidant. Additionally, an upper oxidant nozzle is located above the fuel and lower oxidant nozzles for creating an upper oxidant jet of the oxidant to burn the increasingly more buoyant particles of the fuel. The velocities of the upper and lower oxidant jets can be adjusted independently of their mass flow rates to adjust the flame shape from sharp (convection dominated) to lazy (radiation dominated) without changing the stoichiometry of the flame. Additionally, the present invention provides a furnace containing such a burner for heating a melt confined between bottom and sidewalls of the furnace.

32 Claims, 5 Drawing Sheets

FUEL-BURNER APPARATUS AND METHOD FOR USE IN A FURNACE

BACKGROUND OF THE INVENTION

The present invention relates to a fuel-burner apparatus and method wherein a fuel is burned in an oxidant to heat a furnace heat-load, such as glass, ferrous and non-ferrous melts and etc. More particularly, the present invention relates to a fuel-burner apparatus and method involving globally-enhanced mixing of the oxidant and fuel.

Furnaces used in heating thermal loads such as glass and metal melts typically incorporate one or more burners set within burner blocks along the sides of the furnace. The burner produces the required heat by burning a liquid fuel, such as No. 2 or No. 6 fuel oil or a gaseous fuel such as natural gas in an oxidant such as oxygen or oxygen-enriched air. The resultant flame extends over the melt and heat is transferred from the flame to the melt by radiation and conduction.

Global-enhancement burners are provided in which the mixing of the oxidant and the fuel occurs over a large area as opposed to a localized mixing of the oxidant and fuel. As a result, a broad flame is produced having a controlled heat release pattern which can be quite uniform throughout the flame. An example of a global enhancement burner can be found in U.S. Pat. No. 4,927,357, in which a non-axisymmetric oxidant nozzle is located below a fuel nozzle to produce a low-pressure field of the oxidant below the fuel nozzle. The low-pressure field enhances aspiration of the fuel into the oxidant. The oxidant and fuel jets produced by the oxidant and fuel nozzles fan out from the burner so that the mixing between the two occurs over a wide area. The resultant flame produced by combustion of the fuel within the oxidant has quite a uniform heat distribution with the virtual elimination of hot spots. In some operating regimes, a long flame is produced in which unburned particles of fuel become increasingly more buoyant along the length of the flame. The disadvantage of this is that unburned particles of fuel at the end of the flame rise to burn outside of the oxidant provided directly through the burner in a controlled manner. This is typically observed as the flame licking up at its end. As a result, part of the heat released by the flame is diverted from the heat-load to the top or crown of the furnace.

Another disadvantage of many prior art burners, including global-enhancement burners, is that it is difficult to control the mode of heat transfer to the melt without changing the stoichiometry of the flame. In this regard, certain types of melts are highly reflective of radiant heat. In such case, it is known that more effective heat transfer can be obtained with a convective-type flame. One way to achieve this is to increase the velocity of the oxidant jet and thereby sharpen the flame pattern from a lazy flame pattern. A sharp flame results in a lower degree of radiative and a higher degree of convective heat transfer than a lazy flame. However, it is difficult to control the oxidant velocity independently of oxidant mass flow rate without a sophisticated flow-control system. As such, an increase in oxidant velocity is accompanied by a decrease in oxidant mass flow-rate. The decreased oxidant mass-flow rate changes the stoichiometry of the reaction between the fuel and the oxidant to in turn, change the rate at which heat is released by the flame and may result in unburned fuel in the exhaust system of the furnace.

As will be discussed, the present invention provides a burner that more effectively aspirates the fuel into the oxidant to prevent the more buoyant particles of fuel from burning outside of the oxidant. Additionally, a burner of the present invention allows for the velocity of the oxidant to be controlled independently of its mass flow rate to selectively produce either sharp or lazy flame patterns without affecting the stoichiometry of the reaction between the fuel and oxidant. As a result, the heat release characteristics of the flame can be adjusted from radiation dominated to convection dominated independently of stochiometry.

SUMMARY OF THE INVENTION

The present invention provides a burner for burning fuel and an oxidant. Fuel nozzle means are provided for producing a fuel jet of the fuel adapted to burn within the oxidant with an outwardly extending flame and such that particles of the fuel become increasingly more buoyant along the length of the flame. Lower oxidant nozzle means are provided below the fuel nozzle means for creating a lower oxidant jet of the oxidant that produces a low-pressure field below the fuel jet for downwardly aspirating the fuel into the oxidant. Upper oxidant nozzle means is located above the fuel and lower oxidant nozzle means for creating an upper oxidant jet to burn the increasingly more buoyant particles of fuel. The upper oxidant jet, by burning the increasingly more buoyant particles of the fuel, prevents the fuel from burning outside of the oxidant. This in turn more effectively utilizes the oxidant so that the flame does not lick up at its end to heat the crown of the furnace. It is to be noted that fuel is upwardly asperated into the upper oxidant jet due to its low pressure as compared with the fuel jet. However, oxidant asperation into the fuel from the lower oxidant jet is much more effective than that provided by the upper oxidant jet and thus, predominates in this function. Although not specifically mentioned, this is understood to be the case in the description and claims of the subject invention set forth hereinbelow.

The upper and lower oxidant nozzle means can be formed in an oxidant duct having an open front end from which the upper and lower oxidant jets are discharged and an inlet spaced behind the open front end of the oxidant duct to receive the oxidant under pressure. A central fuel body is recessed within the oxidant duct and located between the open front end and the inlet of the oxidant duct. The central fuel body and the oxidant duct can have two opposed, spaced sets of top and bottom surfaces, separated by the central fuel body and shaped to define converging/diverging upper and lower nozzles through which the oxidant is adapted to be forced to create the upper and lower oxidant jets. The upper and lower nozzles have a ratio of transverse cross-sectional areas of less than unity such that a greater mass flow of the oxidant passes through the lower nozzle than the upper nozzle and thereby, the low-pressure field is produced in the lower oxidant jet. The fuel nozzle means can comprise a fuel nozzle configured to form the fuel jet. The fuel nozzle is frontally located on the central fuel body such that the fuel jet is discharged through the open front end of the oxidant duct between the upper and lower oxidant jets. Fuel supply means are provided for supplying the fuel under pressure to the fuel nozzle.

The open front end of the oxidant duct can be horizontally flared and shaped such that the upper and lower oxidant jets assume a horizontally divergent, fan-shaped configuration upon discharge therethrough. The fuel nozzle can also be configured such that the fuel jet has the horizontally divergent, fan-shaped configuration of the upper and lower oxidant jets. As a result, mixing between the oxidant and the fuel occurs globally, over a wide area and in quite a uniform manner.

The central fuel body can be adapted for movement toward and away from the open front end of the oxidant duct. In such case, the transverse cross-sectional areas of the upper and lower nozzles are variable, decreasing and increasing as the fuel body is moved away from and toward the front end of the oxidant duct, respectively. The upper and lower nozzles can also be shaped such that their transverse cross-sectional area ratio remains constant at any location along the oxidant duct and at any position of the central fuel body. Therefore, in any position of the fuel nozzle, the lower oxidant jet produces the low-pressure field. The oxidant nozzle means also can be provided with selective movement means for selectively moving the central fuel body to selective positions, toward and away from the open front end of the oxidant duct. As a result, selective movement of the central fuel body away from and towards the open front end of the oxidant duct simultaneously increases and decreases oxidant jet velocity in accordance with the decrease and increase of the transverse, cross-sectional areas of the upper and lower nozzles to selectively impart to the flame sharp and lazy configurations. Additionally, the upper and lower oxidant nozzles can also be shaped such that at burner operating pressure, the oxidant follows the shape of the two opposed, spaces sets of top and bottom surfaces forming the upper and lower nozzles. The effect of this is that at a given burner operating pressures, the mass flow rate of oxidant remains essentially constant in any position of the central fuel body. Thus, sharp and lazy flame configurations can be selected at will without changing the stoichiometry of the reaction between the fuel and the oxidant.

In another aspect of the present invention, a furnace is provided having an insulated enclosure and one or more burners. The insulated enclosure has connected top, bottom and side walls to confine a melt above and between the side and bottom walls of the enclosure. At least one burner is provided that projects into the furnace, above the melt. The burner has fuel nozzle means for producing a fuel jet of the fuel adapted to burn within the oxidant with an outwardly extending flame and such that particles of fuel become increasingly more buoyant along the length of the flame. Lower oxidant nozzle means are located below the fuel nozzle means for creating a lower oxidant jet that produces a low-pressure field below the fuel jet for downwardly aspirating the fuel into the oxidant. Upper oxidant nozzle means are provided above the fuel and lower oxidant nozzle means for creating an upper oxidant jet of the oxidant burning the increasingly more buoyant particles of the fuel to prevent the outwardly extending flame from being diverted toward the top wall of the furnace and away from the melt. The at least one burner can be constructed from the oxidant duct and fuel body described above together with the advantageous features thereof.

In yet another aspect, the present invention provides a method of burning fuel in an oxidant. The method comprises producing a jet of the fuel adapted to burn within the oxidant with an outwardly extending flame and such that particles of the fuel become increasingly more buoyant along the length of the flame. A lower jet of oxidant is created below the jet of the fuel that produces a low-pressure field for downwardly aspirating the field into the oxidant. An upper jet of the oxidant is created above the jet of the fuel and the lower jet of the oxidant to burn the increasingly more buoyant particles of the fuel.

In a further aspect, the present invention provides a method of heating a melt. In accordance with such method, the melt is confined within an insulated enclosure, having connected top, bottom, and side walls, between the side and bottom walls of the insulated enclosure. A fuel jet of a fuel is produced above the melt, adapted to burn within an oxidant with an outwardly extending flame and such that particles of the fuel become increasingly more buoyant along the length of the flame. A lower oxidant jet of an oxidant is created below the fuel jet and above the melt that produces a low-pressure field below the fuel jet for downwardly aspirating the fuel into the oxidant. An upper oxidant jet of the oxidant is created above the fuel and lower oxidant jets burning the more buoyant particles of the fuel and thereby preventing the outwardly extending flame from being diverted toward the top wall of the furnace and away from the melt.

BRIEF DESCRIPTION OF THE DRAWINGS

While the specification concludes with claims distinctly pointing out the subject matter that Applicant regards as his invention, it is believed that the present invention will be better understood when taken in conjunction with the accompanying drawings in which:

DETAILED DESCRIPTION

Figure 1:
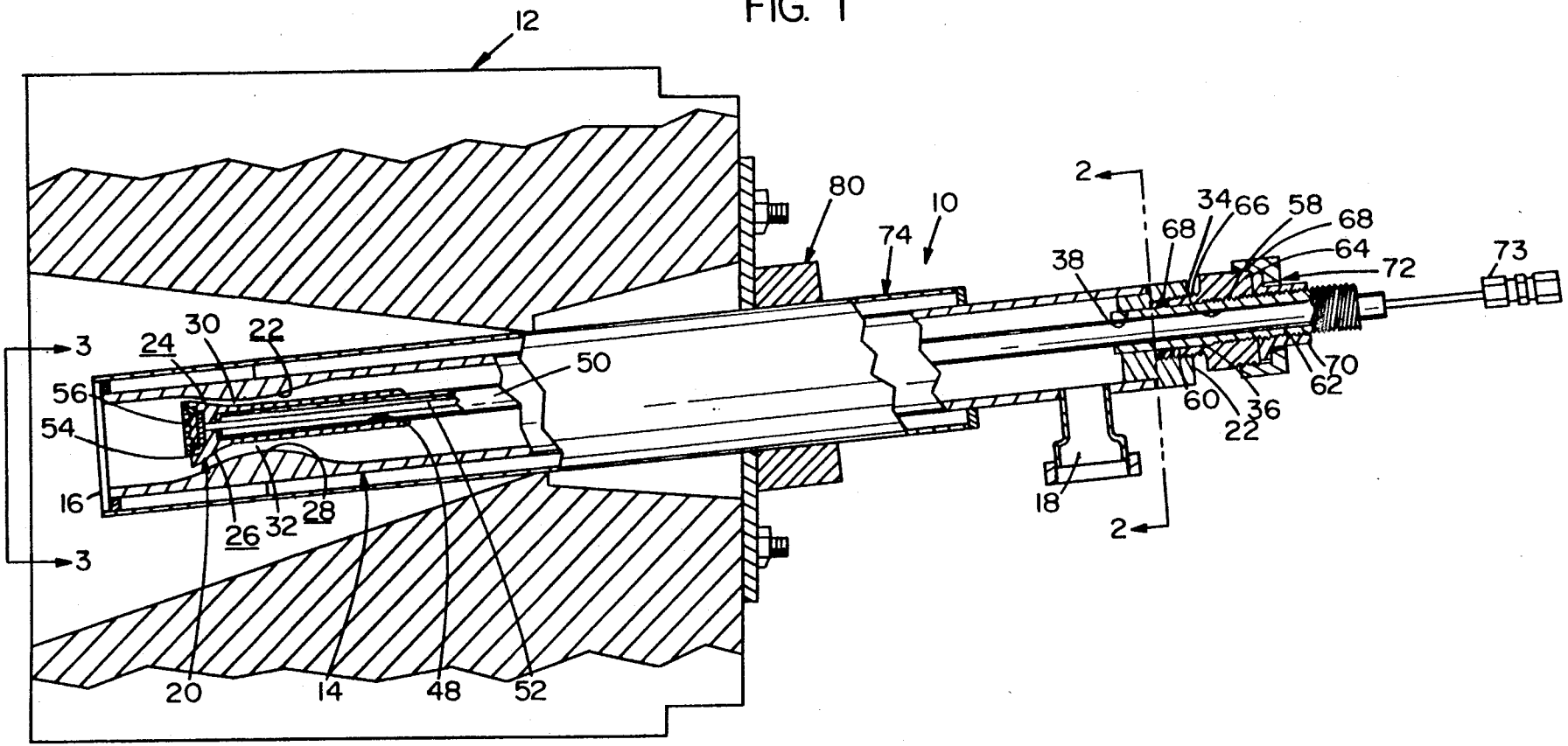
FIG. 1 is an elevational view of a burner in accordance with the present invention set within a burner block of a furnace with portions of the burner and burner block broken away.
Figure 2:
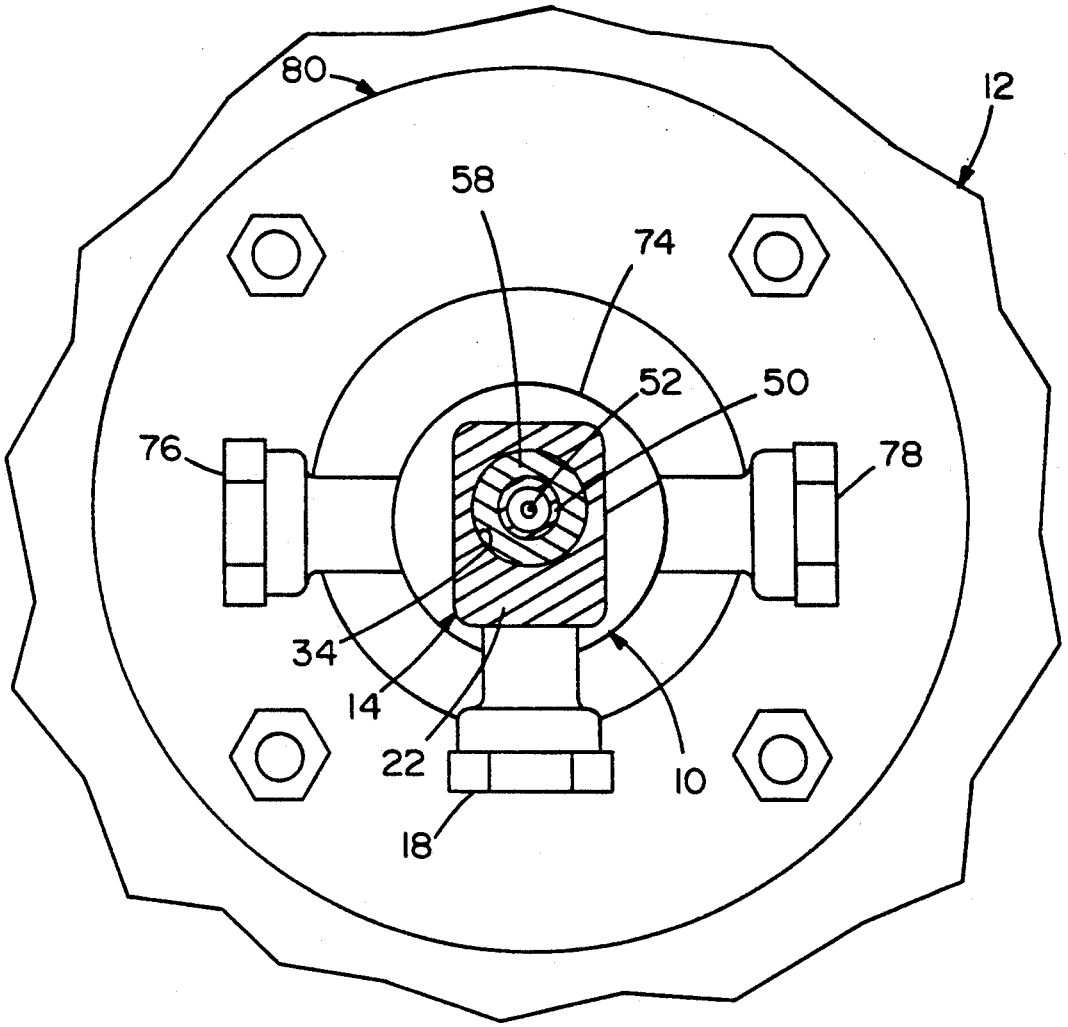
FIG. 2 is an enlarged end view of the burner illustrated in FIG. 1.
Figure 3:
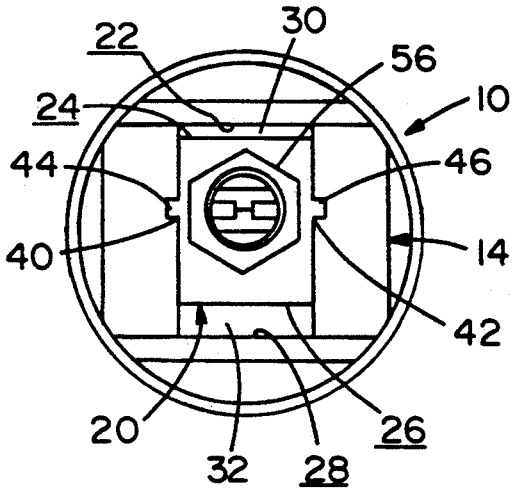
FIG. 3 is an enlarged view of FIG. 1 taken along line 3—3 thereof.

With reference to FIG. 1-3, a burner 10 in accordance with the present invention is illustrated in an operative condition, set within a burner block 12 of a furnace. Burner 10 is provided with an oxidant duct 14 having an open front end 16 from which the upper and lower oxidant jets are discharged along with the flame resulting from burning fuel within the oxidant. Oxidant enters oxidant duct 14 under pressure through an inlet 18 spaced behind open front end 16 thereof. A central fuel body 20 is recessed within oxidant duct 14 and is located between open front end 16 and inlet 18. Central fuel body 20 and oxidant duct 14 have two opposed sets of spaced top and bottom surfaces, 22 and 24; 26 and 28, respectively, shaped to define converging/diverging upper and lower nozzles 30 and 32. Oxidant is forced through upper and lower nozzles 30 and 32 by the pressure to create the upper and lower oxidant jets.

Oxidant duct 14, at rear end 22, is provided with an axial bore 34 having threaded and unthreaded portions 36 and 38 for purposes that will become apparent. Near open front end 16 of oxidant duct 14, a pair of opposed tracks 40 and 42 are defined on the inside of oxidant duct 14. Central fuel body 20 is provided with opposed, horizontal projections 44 and 46. Projections 44 and 46 are designed to slide within tracks 40 and 42 to allow central fuel body 20 to slide in an axial direction of oxidant duct 14, forward and backward, while being supported in position.

Central fuel body 20 has an inner bore 48 within which a tube-like vacuum jacket 50 projects at one end thereof. Vacuum jacket 50, in turn, encloses a fuel line 52 which passes through an opening 54 of vacuum jacket 50. Vacuum jacket 40, as may be appreciated, prevents heating or cooling of the fuel by conduction. A fuel nozzle 56 is frontally located on central fuel body 16 and in communication with fuel line 52. Fuel under pressure is supplied to nozzle 56 through fuel line 52 such that a fuel jet is discharged through open front end 16 of oxidant duct 14, between the upper and lower oxidant jets.

Vacuum jacket 50 is sheathed by a sheath 58 having an unthreaded section 60, passing through axial bore 34 of oxidant duct 14, and a threaded section 62. A packing nut 64 having narrow and wide threaded portions 66 and 68 is threadably engaged, at narrow threaded portion 66, within threaded portion 36 of axial bore 34. Packing nut 64 is tightened within threaded portion 36 of axial bore 34 to bear against a teflon packing 68 that seals oxidant duct 14 at the entry of sheath 58. An adjustment nut 70 is threaded onto threaded section 62 of sheath 58. Adjustment nut 58 is retained by a lock nut 72 threaded onto wide threaded portion 68 of packing nut 64 so that rotation of adjustment nut 70 acts on sheath 58 and thus, vacuum jacket 40, to move central fuel body 20 in either a forward or backward direction. The action of adjustment nut 70 is frozen by tightening lock nut 72 on packing nut 64. Fuel line 52 projects from the other end of vacuum jacketing 50 and is connected to a pipe fitting 73 which is configured to be connected to a pressurized fuel source.

The upper and lower nozzles 30 and 32 or more exactly, the two opposed sets of top and bottom surfaces 22, 24; and 26, 28 of oxidant duct 14 and central fuel body 20 are very specially shaped. At any location of oxidant duct 14 and at any position of central fuel body 20, the ratio of transverse, cross-sectional areas between upper and lower nozzles 30 and 32 will be less than unity and will also remain the same. The result of this is that a greater mass flow rate of oxidant will be discharged from lower nozzle 32 than upper nozzle 30 and the the lower oxidant jet will produce a low-pressure field beneath the fuel jet which will downwardly aspirate the fuel jet into the oxidant jet to produce complete mixing between the two. The upper fuel jet, having a lower mass flow rate, does not have the same influence on the fuel jet. As stated previously, unburned fuel particles travel along the length of the flame and tend to become more buoyant as they are heated. The buoyancy of such unburned fuel particles causes the flame to lick up because fuel particles are either not burnt or are burned in airborne oxygen. The upper oxidant jet burns the more buoyant particles of fuel to prevent the flame from licking up at the end, and therefore wasting the heat value of this part of the fuel.

Figure 4:
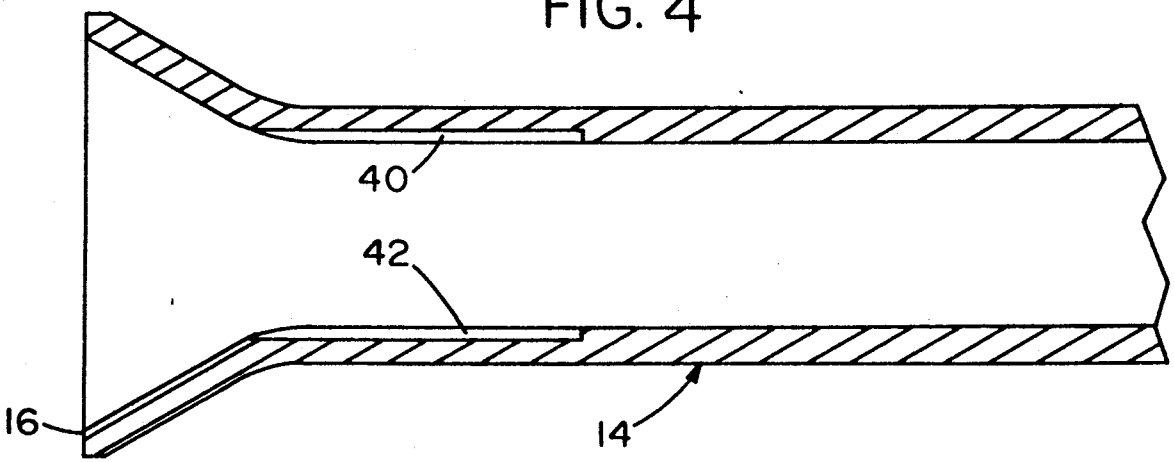
FIG. 4 is a fragmentary, top sectional view of an oxidant duct of the burner illustrated in FIG. 1.

With reference now to FIG. 4. open front end 16 of oxidant duct 14 is horizontally and outwardly flared and specifically shaped such that the upper and lower oxidant jets will be of a horizontally divergent fan shaped configuration. Additionally, the upper and lower nozzles 30 and 32 are also of rectangular transverse cross-section such that divergence of the upper and lower oxidant jets in the vertical direction is minimized. Fuel nozzle 56 is designed such that the fuel jet issuing therefrom has the same configuration as the oxidant jets. In this regard, for liquid fuels fuel nozzle 56 can be a nozzle 500033 manufactured by Spraying Systems Co. of Wheaton, Ill. 60188. The end result of the oxidant and fuel nozzle design is that the fuel mixes with the oxidant over a wide area and thus, burner 10 can be said to be a global enhancement burner. As can be appreciated, fuel nozzle 56 could be designed for gaseous fuels.

As central fuel body 20 is moved rearwardly, away from open front end 16 of oxidant duct 14, the transverse cross-sectional areas of upper and lower nozzles 30 and 32 will simultaneously decrease. The decrease in areas will increase the velocities of the upper and lower oxidant jets. When central fuel body 20 is moved in a forward direction, toward open front end 16 of oxidant duct 14, the reverse action will take place, that is velocities of the upper and lower oxidant jets will decrease. Thus, adjustment of adjustment nut 70 will control the velocity of the upper and lower oxidant jets and thus will allow the flame configuration to be selected as either a sharp flame configuration (at increased oxidant jet velocity) or a lazy flame configuration (at reduced oxidant jet velocities).

The upper and lower nozzles 30 and 32 are also specially shaped such that at a given pressure, the mass flow rates of the upper and lower oxidant jets will remain substantially constant at any position of central fuel body 20. It has been found that using pure oxygen as an oxidant and No. 2 fuel oil as fuel, at pressures up to 10 psig, there was at most about a 1% to 3% difference in the mass flow rate of the oxidant passing through burner 10 as central fuel body 20 was successively moved from a position in which the points of inflection of the curves of the central fuel body and the oxidant duct were lined up, to successive forward movements of central fuel body 20, 3 mm. and 6 mm.

It is also to be noted that the shape of upper and lower nozzles 30 and 32 results in a quiet operation of burner 10. At 100% firing, that is a full 110 kW rated output of burner 10, a noise level of 88.7 dba was measured directly in front of burner 10 which increased to 89.9 dba at 30° off the center line of burner 10, to 90.2 dba at 60° off center line of burner 10, to 92.2 dba at 90° off center line of burner 10. Prior art burners of equivalent output would be expected to generate a noise level of from anywhere of 100 dba to about 110 dba.

The advantages inherent in the operation of burner 10, such as have been discussed above, arise from the fact that the oxidant tends to follow the curvatures of surfaces 22, 24, 26, and 28 without separation at the operating pressure range of burner 10 (2 to 10 psig). Among other important advantages arising from such smooth flow is that the flame is stabilized with high turn-up and turn-down ratios. In other words, burner 10 produces a stable flame over wide mass flow ratios of oxidant and fuel, and therefore under wide ranges of heat output. Furthermore, the pressure drop at the oxidant is low and therefore, there is no need to compress oxygen by the use of oxygen compressors with the use of burner 10.

Figure 5:
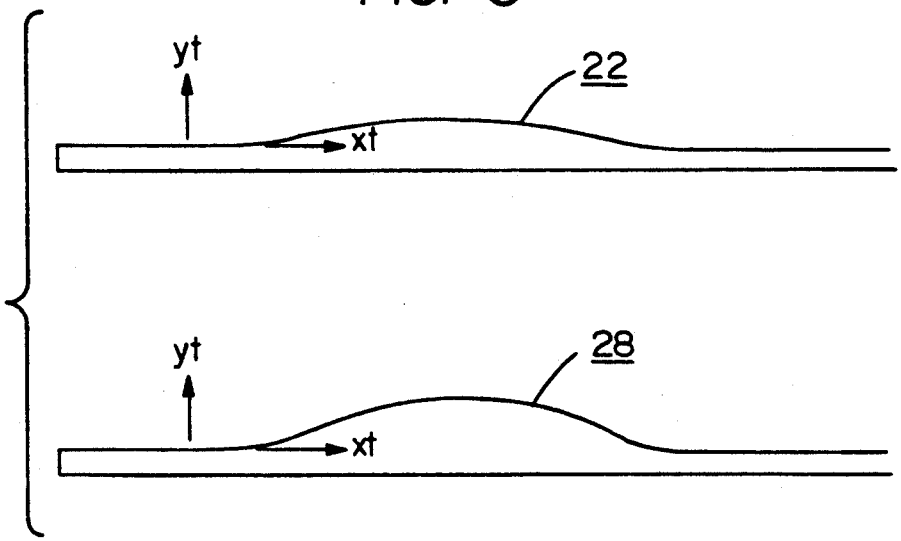
FIG. 5 is a graph showing the curvature of the inner surfaces of the oxidant duct.
Figure 6:
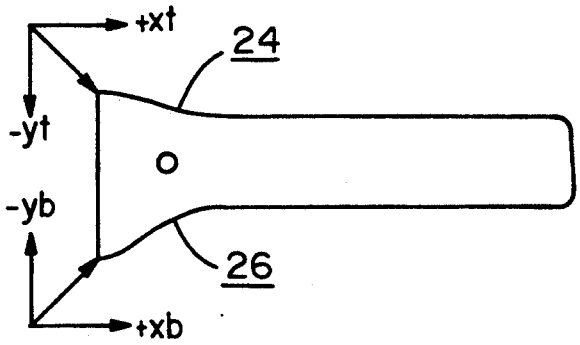
FIG. 6 is a graph showing the curvature of the upper and lower surfaces of a central fuel body of the burner illustrated in FIG. 1.

With reference to FIGS. 5 and 6, oxidant duct 14 and central fuel body 16 are machined so that the ratio between the transverse cross-sectional areas of upper and lower oxidant nozzle was 1:2. The exact machining specification is as follows:

OXIDANT DUCT MACHINING COORDINATES

| xm (mm) | yobm (mm) | yotm (mm) | xm (mm) | yobm (mm) | yotm (mm) |
|---|---|---|---|---|---|
| −24 | 0 | 0 | 51 | 9.846 | 4.923 |
| 0 | 0 | 0 | 52 | 9.819 | 4.910 |
| 1 | .021 | .011 | 53 | 9.786 | 4.893 |
| 2 | .047 | .024 | 54 | 9.745 | 4.873 |
| 3 | .081 | .040 | 55 | 9.695 | 4.847 |
| 4 | .122 | .061 | 56 | 9.633 | 4.817 |
| 5 | .172 | .086 | 57 | 9.560 | 4.780 |
| 6 | .233 | .117 | 58 | 9.471 | 4.736 |
| 7 | .307 | .154 | 59 | 9.367 | 4.684 |
| 8 | .395 | .120 | 60 | 9.246 | 4.623 |
| 9 | .499 | .250 | 61 | 9.105 | 4.552 |
| 10 | .621 | .311 | 62 | 8.943 | 4.471 |
| 11 | .762 | .381 | 63 | 8.759 | 4.380 |
| 12 | .924 | .462 | 64 | 8.553 | 4.276 |
| 13 | 1.108 | .554 | 65 | 8.322 | 4.161 |
| 14 | 1.314 | .657 | 66 | 8.069 | 4.034 |
| 15 | 1.544 | .772 | 67 | 7.792 | 3.896 |
| 16 | 1.798 | .899 | 68 | 7.492 | 3.746 |
| 17 | 2.075 | 1.038 | 69 | 7.171 | 3.585 |
| 18 | 2.375 | 1.188 | 70 | 6.830 | 3.415 |
| 19 | 2.696 | 1.348 | 71 | 6.473 | 3.236 |
| 20 | 3.037 | 1.518 | 72 | 6.101 | 3.051 |
| 21 | 3.394 | 1.697 | 73 | 5.718 | 2.859 |
| 22 | 3.766 | 1.883 | 74 | 5.328 | 2.664 |
| 23 | 4.149 | 2.074 | 75 | 4.933 | 2.467 |
| 24 | 4.539 | 2.270 | 76 | 4.539 | 2.270 |
| 25 | 4.933 | 2.467 | 77 | 4.149 | 2.074 |
| 26 | 5.328 | 2.664 | 78 | 3.766 | 1.883 |
| 27 | 5.718 | 2.859 | 79 | 3.394 | 1.697 |
| 28 | 6.101 | 3.051 | 80 | 3.037 | 1.518 |
| 29 | 6.473 | 3.236 | 81 | 2.696 | 1.348 |
| 30 | 6.830 | 3.415 | 82 | 2.375 | 1.188 |
| 31 | 7.171 | 3.585 | 83 | 2.075 | 1.038 |
| 32 | 7.492 | 3.746 | 84 | 1.798 | .899 |
| 33 | 7.792 | 3.896 | 85 | 1.554 | .772 |
| 34 | 8.069 | 4.034 | 86 | 1.314 | .657 |
| 35 | 8.322 | 4.161 | 87 | 1.108 | .554 |
| 36 | 8.553 | 4.276 | 88 | .924 | .462 |
| 37 | 8.759 | 4.380 | 89 | .762 | .381 |
| 38 | 8.943 | 4.471 | 90 | .621 | .311 |
| 39 | 9.105 | 4.552 | 91 | .499 | .250 |
| 40 | 9.246 | 4.623 | 92 | .395 | .198 |
| 41 | 9.367 | 4.684 | 93 | .307 | .154 |
| 42 | 9.471 | 4.736 | 94 | .233 | .117 |
| 43 | 9.560 | 4.780 | 95 | .172 | .086 |
| 44 | 9.633 | 4.817 | 96 | .122 | .061 |
| 45 | 9.595 | 4.847 | 97 | .081 | .040 |
| 46 | 9.745 | 4.873 | 98 | .047 | .024 |
| 47 | 9.786 | 4.893 | 99 | .021 | .011 |
| 48 | 9.819 | 4.910 | 100 | 0 | 0 |
| 49 | 9.846 | 4.923 | | | |
| 50 | 9.867 | 4.933 | | | |

CENTRAL FUEL BODY MACHINING COORDINATES

| xm (mm) | yfbm (mm) | yftm (mm) | xm (mm) | yfbm (mm) | yftm (mm) |
|---|---|---|---|---|---|
| 0 | 0 | 0 | 17 | −8.654 | −4.327 |
| 1 | −.227 | −.113 | 18 | −8.88- | −4.440 |
| 2 | −.520 | −.260 | 19 | −9.055 | −4.527 |
| 3 | −.884 | −.442 | 20 | −9.180 | −4.590 |
| 4 | −1.325 | −.663 | 21 | −9.271 | −4.635 |
| 5 | −1.838 | −.919 | 22 | −9.332 | −4.666 |
| 6 | −2.415 | −1.208 | 23 | −9.373 | −4.687 |
| 7 | −3.058 | −1.529 | 24 | −9.399 | −4.700 |
| 8 | −3.798 | −1.899 | 25 | −9.417 | −4.708 |
| 9 | −4.440 | −2.220 | 26 | −9.426 | −4.713 |
| 10 | −5.083 | −2.541 | 27 | −9.433 | −4.716 |
| 11 | −5.822 | −2.911 | 28 | −9.436 | −4.718 |
| 12 | −6.465 | −3.233 | 29 | −9.438 | −4.719 |
| 13 | −7.043 | −3.521 | 30 | −9.439 | −4.720 |
| 14 | −7.555 | −3.778 | 31 | −9.440 | −4.720 |
| 15 | −7.996 | −3.998 | 84 | −9.440 | −4.720 |

For both oxidant duct 14 and central fuel body 12, "bm" denotes bottom machining coordinates, while "tm" denotes top machining coordinates.

As may be appreciated, a great deal of heat is generated by burner 10, which is conducted within oxidant duct 14. This heat is carried away by cooling water flowing through a water jacket 74 surrounding oxidant duct 14. Water jacket has inlet and outlets 76 and 78 formed by appropriate fittings for cooling water to enter and leave water jacket 74 after circulating around oxidant duct 14. Burner 10 is mounted within burner block 12 by a clamp 80 connected to burner block 12 and clamped about water jacket 74.

Figure 7:
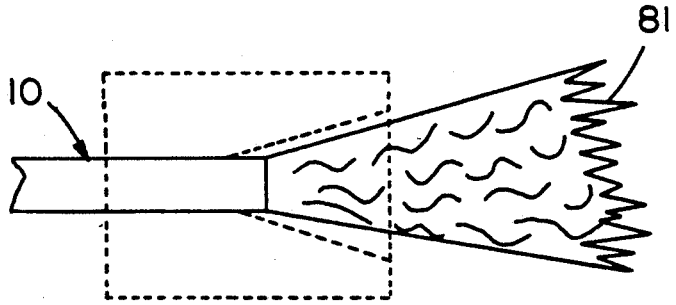
FIG. 7 is a fragmentary, top view of FIG. 1 with the burner operating to produce a sharp flame and with the outline of the burner block shown as dashed lines.
Figure 8:
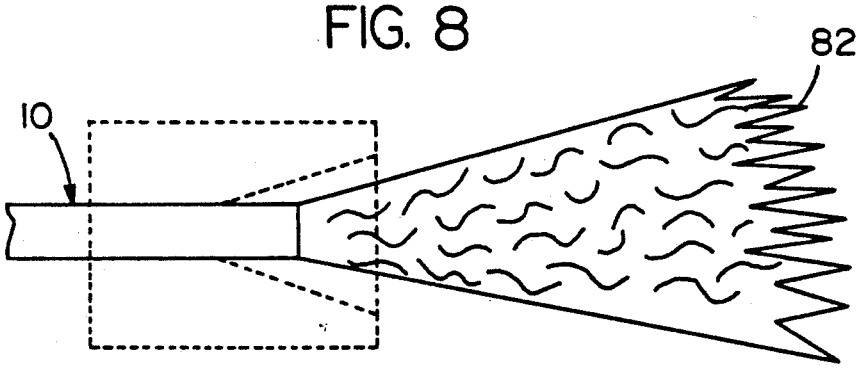
FIG. 8 is a fragmentary, top view of FIG. 1 with the burner operating to produce a lazy flame and with the outline of the burner block shown as dashed lines.
Figure 9:
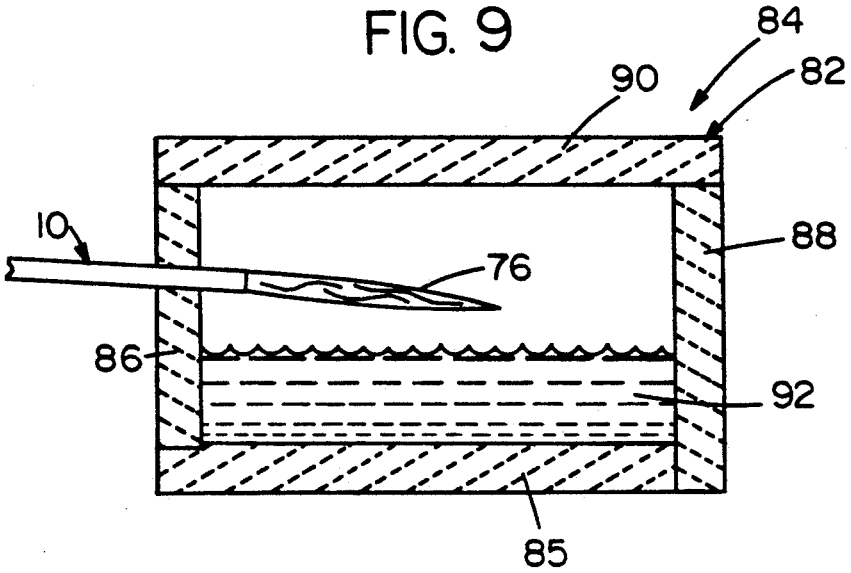
FIG. 9 is a cross-sectional view of a furnace incorporating the burner of FIG. 1, heating a heat load of molten glass.

With reference to FIGS. 7 and 8, burner 10 is shown to be emitting a sharp flame 81 and a lazy flame 82 both of which are horizontally divergent and fan-shaped. As can be seen in FIG. 9, burner 10 projects sharp flame 81 into an insulated enclosure 82 of a furnace 84. Insulated enclosure 82 has bottom, side and top walls 85, 86, 88 and 90. A melt 92 is confined between bottom wall 85 and sidewalls 86 and 88, below burner 10. As is apparent from this illustration, sharp flame 81 has very little vertical divergence and does not lick up at the end to heat top wall 90 of insulated enclosure 82. Although burner 10 is set in burner block 12 in a downward angle, this is peculiar to the illustrated furnace and as would be known, burner 10 could be used in a level orientation. Although not illustrated, but as would be well known in the art, furnace 84 would have an inlet for the raw material for the melt and an outlet for the melt. Moreover, a chimney would also be provided to discharge the combustion products of the burned fuel.

It is to be noted that many individual features of burner 10 are advantageous and could be incorporated into a burner design without use of other features of burner 10 in such design. For instance, a burner could be constructed with an upper oxidant nozzle to produce an oxidant jet to burn more buoyant particles of fuel and a lower oxidant nozzle to produce a low pressure oxidant jet below the fuel jet. In such case, the burner would not have to constructed to incorporate each and every feature shown in FIG. 10. As another possible embodiment, a burner could incorporate the structure of the preferred embodiment with a fixed central fuel body preset to burn fuel within an oxidant with either a sharp or a lazy flame.

While a preferred embodiment of the present invention has been shown and described in detail here and above, as will occur to those skilled in the art, numerous omissions, changes, and additions may be made without departing from the spirit and scope of the invention.

I claim:

1. A burner for burning fuel in an oxidant comprising:

fuel nozzle means for producing a fuel jet of the fuel adapted to burn within the oxidant with an outwardly extending flame and such that particles of the fuel become increasingly more buoyant along the length of the flame;

lower oxidant nozzle means located below the fuel nozzles means for creating a lower oxidant jet of the oxidant that produces a low-pressure field below the fuel jet for downwardly aspirating the fuel into the oxidant; and upper oxidant nozzle means located above the fuel and lower oxidant nozzle means for creating an upper oxidant jet of the oxidant burning the increasingly more buoyant particles of the fuel;

the upper and lower oxidant nozzle means being independent and distinct from one another.

2. The burner of claim 1, wherein the fuel and oxidant jets and flame are outwardly divergent and fan shaped such that mixing of the fuel into the oxidant occurs over a wide area.

3. The burner of claim 1 wherein the upper and lower oxidant nozzle means have selective velocity control means for simultaneously controlling upper and lower oxidant jet velocities independently of upper and lower oxidant jet mass flow rates to selectively produce lazy and sharp flame configurations.

4. The burner of claim 2 wherein the upper and lower oxidant nozzle means have selective velocity control means for simultaneously controlling upper and lower oxidant jet velocities independently of upper and lower oxidant jet mass flow rates to selectively produce lazy and sharp flame configurations.

5. The burner of claim 1, wherein:

the upper and lower oxidant nozzle means comprise:

an oxidant duct having an open front end from which the upper and lower oxidant jets are discharged and an inlet spaced behind the open front end to receive the oxidant under pressure;

a central fuel body, recessed within the oxidant duct and located between the open front end and the inlet of the oxidant duct; and the central fuel body and the duct having two opposed, spaced sets of top and bottom surfaces, separated by the central fuel body and shaped to define converging/diverging upper and lower nozzles through which the oxidant is adapted to be forced to create the upper and lower oxidant jets;

the upper and lower nozzles having a ratio of transverse cross-sectional areas of less than unity such that a greater mass flow of the oxidant passes through the lower nozzle than the upper nozzle and thereby, the low-pressure field is produced in the lower oxidant jet; and the fuel nozzle means comprise:

a fuel nozzle configured to form the fuel jet, the fuel nozzle frontally located on the central fuel body such that the fuel jet is discharged through the open front end of the oxidant duct between the upper and lower oxidant jets; and fuel supply means for supplying the fuel under pressure to the fuel nozzle.

6. The burner of claim 5, wherein:

the open front end of the oxidant duct is horizontally flared and shaped such that the upper and lower oxidant jets assume a horizontally divergent, fan-shaped configuration upon discharge therethrough; and the fuel nozzle is also configured such that the fuel jet has the horizontally divergent, fan-shaped configuration of the upper and lower oxidant jets, whereby mixing between the oxidant and the fuel occurs over a wide area and the burner is thus a global enhancement burner.

7. The burner of claim 6, wherein the transverse, cross-sectional areas of the upper and lower oxidant nozzles and the oxidant duct are all of rectangular configuration to limit vertical divergence of the oxidant jets and therefore, the flame.

8. The burner of claim 5, wherein:

the central fuel body is adapted for movement toward and away from the open front end of the oxidant duct;

the transverse cross-sectional areas of the upper and lower nozzles are variable, decreasing and increasing as the fuel body is moved away from and toward the front end of the oxidant duct, respectively, and the upper and lower nozzle are also shaped such that their said area ratio remains constant at any location along the oxidant duct and at any position of the central fuel body and oxidant mass flow rate of the upper and lower oxidant jets remains essentially constant at any position of the central fuel body; and the oxidant nozzle means also have selective movement means for selectively moving the central fuel body to selective positions, towards and away from the open front end of the oxidant duct, whereby selective movement of the central fuel body away from and towards the open front end of the oxidant duct simultaneously increases and decreases oxidant jet velocity in accordance with the decrease and increase in the transverse cross-sectional areas of the upper and lower nozzles, thereby imparting to the flame sharp and lazy configurations in substantial independence of the oxidant mass flow rate.

9. The burner of claim 7, wherein:

the open front end of the oxidant duct is horizontally flared and shaped such that the upper and lower oxidant jets assume a horizontally divergent, fan-shaped configuration upon discharge therethrough; and the fuel nozzle is also configured such that the fuel jet has the horizontally divergent, fan-shaped configuration of the upper and lower oxidant jets, whereby mixing between the oxidant and the fuel occurs over a wide area of the flame and the burner is thus a global enhancement burner.

10. The burner of claim 9, wherein the transverse, cross-sectional areas of the upper and lower oxidant nozzles are of rectangular configuration to limit vertical divergence of the oxidant jets and therefore, the flame.

11. The burner of claim 8, wherein:

the oxidant duct also has a rear end located opposite to the front end thereof and having an opening the central fuel body has a lengthwise extending passageway;

the fuel supply means comprises a vacuum jacketed fuel line, at one end, extending through the lengthwise extending passageway and in communication with the fuel nozzle and, at the other of its said ends, extending through the rear end opening of the oxidant duct; and 12. The burner of claim 11, wherein the oxidant duct is jacketed by a water jacket having a water inlet and a water outlet for circulating cooling water through the water jacket.

13. A furnace comprising:

an insulated enclosure having connected top, bottom and side walls to confine a melt above between the side and bottom walls of the enclosure; and at least one burner projecting into the furnace above the melt, the at lease one burner comprising:

fuel nozzle means for producing a fuel jet of a fuel adapted to burn within the oxidant with an outwardly extending flame located above the melt, and such that particles of the fuel become increasingly more buoyant along the length of the flame;

lower oxidant nozzle means located below the fuel nozzle means for creating a lower oxidant jet of an oxidant that produces a low-pressure field below the fuel jet for downwardly aspirating the fuel into the oxidant; and upper oxidant nozzle means located above the fuel and lower oxidant nozzle means for creating an upper oxidant jet of the oxidant burning the increasingly more buoyant particles of the fuel, and thereby preventing the outwardly extending flame from being diverted toward the top wall of the furnace and away from the melt;

the upper and lower oxidant nozzle means being independent and distinct from one another.

14. The furnace of claim 13, wherein the fuel and oxidant jets and flame are outwardly divergent and fan shaped such that mixing of the fuel into the oxidant occurs over a wide area of the oxidant.

15. The furnace of claim 13 wherein the upper and lower oxidant nozzle means have selective velocity control means for simultaneously controlling upper and lower oxidant jet velocities independently of upper and lower oxidant jet mass flow rates to selectively produce lazy and sharp flame configurations.

16. The furnace of claim 14 wherein the upper and lower oxidant nozzle means have selective velocity control means for simultaneously controlling upper and lower oxidant jet velocities independently of upper and lower oxidant jet mass flow rates to selectively produce lazy and sharp flame configurations.

17. The furnace of claim 13, wherein:

the upper and lower oxidant nozzle means comprise:

an oxidant duct having an open front end from which the upper and lower oxidant jets are discharged and an inlet spaced behind the open front end to receive the oxidant under pressure;

a central fuel body, recessed within the oxidant duct and located between the open front end and the inlet of the oxidant duct; and the central fuel body and the duct having two opposed, spaced sets of top and bottom surfaces, separated by the central fuel body and shaped to define converging/diverging upper and lower nozzles through which the oxidant is adapted to be forced to create the upper and lower oxidant jets;

the upper and lower nozzles having a ratio of transverse cross-sectional areas of less than one such that a greater mass flow of the oxidant passes through the lower nozzle than the upper nozzle and thereby, the low-pressure field is produced in the lower oxidant jet; and the fuel nozzle means comprise:

a fuel nozzle configured to form the fuel jet, the fuel nozzle frontally located on the central fuel body such that the fuel jet is discharged through the open front end of the oxidant duct between the upper and lower oxidant jets; and fuel supply means for supplying the fuel under pressure to the fuel nozzle.

18. The furnace of claim 17, wherein:

the open front end of the oxidant duct is horizontally flared and shaped such that the upper and lower oxidant jets assume a horizontally divergent, fan-shaped configuration upon discharge therethrough; and the fuel nozzle is also configured such that the fuel jet has the horizontally divergent, fan-shaped configuration of the upper and lower oxidant jets, whereby mixing between the oxidant and the fuel occurs over a wide area and the burner is thus a global enhancement burner.

19. The furnace of claim 18, wherein the transverse, cross-sectional areas of the upper and lower oxidant nozzles and the oxidant duct are all of rectangular configuration to limit vertical divergence of the upper and lower oxidant jets and therefore, the flame.

20. The furnace of claim 17, wherein:

the central fuel body is adapted for movement toward and away from the open front end of the oxidant duct;

the transverse cross-sectional areas of the upper and lower nozzles are variable, decreasing and increasing as the fuel body is moved away from and toward the front end of the oxidant duct, respectively, and the upper and lower nozzle are also shaped such that their said area ratio remains constant at any location along the oxidant duct and at any position of the central fuel body and oxidant mass flow rate remains essentially constant at any position of the central fuel body; and the oxidant nozzle means also have selective movement means for selectively moving the central fuel body to selective positions, towards and away from the open front end of the oxidant duct, whereby selective movement of the central fuel body away from and towards the open front end of the oxidant duct simultaneously increases and decreases oxidant jet velocity independent of oxidant jet mass flow rate in accordance with the decrease and increase in the transverse cross-sectional areas of the upper and lower nozzles, thereby imparting to the flame sharp and lazy configurations.

21. The furnace of claim 19, wherein:

the open front end of the oxidant duct is horizontally flared and shaped such that the upper and lower oxidant jets assume a horizontally divergent, fan-shaped configuration upon discharge therethrough; and the fuel nozzle is also configured such that the fuel jet has the horizontally divergent, fan-shaped configuration of the upper and lower oxidant jets, whereby mixing between the oxidant and the fuel occurs over a wide area of the flame and the burner is thus a global enhancement burner.

22. The furnace of claim 21, wherein the transverse, cross-sectional areas of the upper and lower oxidant nozzles are of rectangular configuration to limit vertical divergence of the oxidant jets and therefore, the flame.

23. The furnace of claim 21, wherein:

the oxidant duct also has a rear end located opposite to the front end thereof and having an opening the central fuel body has a lengthwise extending passageway;

the fuel supply means comprises a vacuum jacketed fuel line, at one end, extending through the lengthwise extending passageway and in communication with the fuel nozzle and, at the other of its said ends, extending through the rear end opening of the oxidant duct;

the selective movement means act on the vacuum jacketed fuel line at the rear end opening of the oxidant duct to selectively move the central fuel body.

24. The furnace of claim 23, wherein the oxidant duct is jacketed by a water jacket having a water inlet and a water outlet for circulating cooling water through the water jacket.

25. A method of burning fuel in an oxidant comprising:

producing a fuel jet of the fuel adapted to burn within the oxidant with an outwardly extending flame and such that particles of the fuel become increasingly more buoyant along the length of the flame;

creating a lower oxidant jet of the oxidant below the fuel jet that produces a low-pressure field below the field jet for downwardly aspirating the fuel into the oxidant; and creating an upper oxidant jet above the fuel and lower oxidant jet configured to burn the increasingly more buoyant particles of the fuel;

the upper and lower oxidant jets being independent and distinct from one another.

26. The method of claim 25, wherein the fuel and oxidant jets and the flame are outwardly divergent and fan-shaped such that mixing of the fuel into the oxidant occurs over a wide area.

27. The method of claim 25, further comprising simultaneously controlling upper and lower oxidant jet velocities independently of upper and lower oxidant jet mass flow rates to selectively product lazy and sharp flame configurations.

28. The method of claim 26, further comprising simultaneously controlling upper and lower oxidant jet velocities independently of upper and lower oxidant jet mass flow rates to selectively produce lazy and sharp flame configurations.

29. A method of heating a melt comprising:

confining the melt in an insulated enclosure, having connected top, bottom, and sidewalls, between the side and bottom walls of the insulated enclosure;

producing a fuel jet of the fuel above the melt, adapted to burn within an oxidant with an outwardly extending flame and such that particles of the fuel become increasingly more buoyant along the length of the flame;

creating a lower oxidant jet of the oxidant below the fuel jet and above the melt that produces a low-pressure field below the fuel jet for downwardly aspirating the fuel into the oxidant; and creating an upper oxidant jet of the oxidant above the fuel and lower oxidant jets configured to burn the increasingly more buoyant particles of the fuel and thereby to prevent the outwardly extending flame from being diverted toward the top wall of the furnace and away from the melt;

the upper and lower oxidant jets being independent and distinct from one another.

30. The method of claim 29, wherein the fuel and oxidant jets and the flame are outwardly divergent and fan-shaped such that mixing of the fuel into the oxidant occurs over a wide area.

31. The method of claim 29, further comprising simultaneously controlling upper and lower oxidant jet velocities independently of upper and lower oxidant jet mass flow rates to selectively produce lazy and sharp flame configurations.

32. The method of claim 29, further comprising simultaneously controlling upper and lower oxidant jet velocities independently of upper and lower oxidant jet mass flow rates to selectively produce lazy and sharp flame configurations.

* * * * *